US010888132B2

(12) United States Patent
Horihata et al.

(10) Patent No.: US 10,888,132 B2
(45) Date of Patent: Jan. 12, 2021

(54) FIBERS FOR ARTIFICIAL HAIR

(71) Applicant: DENKA COMPANY LIMITED, Tokyo (JP)

(72) Inventors: Atsushi Horihata, Kamakura (JP); Atsushi Takei, Kamakura (JP); Rentaroh Suzuki, Tokyo (JP)

(73) Assignee: DENKA COMPANY LIMITED, Tokyo (JP)

( * ) Notice: Subject to any disclaimer, the term of this patent is extended or adjusted under 35 U.S.C. 154(b) by 173 days.

(21) Appl. No.: 16/309,857

(22) PCT Filed: Jun. 27, 2017

(86) PCT No.: PCT/JP2017/023558
§ 371 (c)(1),
(2) Date: Dec. 13, 2018

(87) PCT Pub. No.: WO2018/037706
PCT Pub. Date: Mar. 1, 2018

(65) Prior Publication Data

US 2019/0307192 A1 Oct. 10, 2019

(30) Foreign Application Priority Data

Aug. 23, 2016 (JP) ..... 2016-162689

(51) Int. Cl.
*A41G 3/00* (2006.01)
*A61G 5/00* (2006.01)
(Continued)

(52) U.S. Cl.
CPC ..... *A41G 3/0083* (2013.01); *A41G 3/00* (2013.01); *A41G 5/004* (2013.01); *D01F 6/60* (2013.01);
(Continued)

(58) Field of Classification Search
CPC ..... A41G 3/0083; A41G 5/0046; A41G 3/00; A41G 5/004; D01F 6/60; D01F 1/07;
(Continued)

(56) References Cited

U.S. PATENT DOCUMENTS 5,954,062 A 9/1999 Murata
2008/0314402 A1 12/2008 Shirakashi et al.
(Continued)

FOREIGN PATENT DOCUMENTS

CN 1221583 A 7/1999
CN 101374432 A 2/2009
(Continued)

OTHER PUBLICATIONS

International Search Report dated Aug. 1, 2017, issued in corresponding International Application No. PCT/JP2017/023558, filed Jun. 27, 2017, 2 pages.
(Continued)

*Primary Examiner* — Camie S Thompson
(74) *Attorney, Agent, or Firm* — Christensen O'Connor Johnson Kindness PLLC

(57) ABSTRACT

The present invention is to provide a fiber for artificial hair which can freely change the hairstyle at home while maintaining the wave shape of the fiber.
A fiber for artificial hair having a bending rigidity maintaining ratio defined by formula (1) is 40 to 80% and a heat shrinkage ratio defined by formula (2) is 0.0 to 5.0% is provided.

bending rigidity maintaining ratio (%)=100×{(bending rigidity in a state after conditioning for 24 hours at 30° C.×90% RH)/(bending rigidity in a state after conditioning for 24 hours at 23° C.×50% RH)} (1)

(Continued)

heat shrinkage ratio (%)=100×{(length before heat treatment)−(length after heat treatment for 5 min at 155° C.)}/(length before heat treatment) (2).

11 Claims, 1 Drawing Sheet

(51) Int. Cl.
*D01F 6/60* (2006.01)
*A41G 5/00* (2006.01)

(52) U.S. Cl.
CPC ..... *D10B 2331/02* (2013.01); *D10B 2503/08* (2013.01)

(58) Field of Classification Search
CPC ..... D02G 1/14; D02G 1/20; Y10T 428/2922; C08L 77/02; C08L 77/06; D10B 2331/02; D10B 2503/08
USPC ..... 264/168; 428/369, 364
See application file for complete search history.

(56) References Cited

U.S. PATENT DOCUMENTS

| | | | |
|---|---|---|---|
| 2010/0040807 | A1 | 2/2010 | Horihata |
| 2011/0271976 | A1 | 11/2011 | Sasayama |
| 2012/0052219 | A1 | 3/2012 | Horihata |
| 2016/0255894 | A1 | 9/2016 | Kimura et al. |

FOREIGN PATENT DOCUMENTS

| | | | |
|---|---|---|---|
| JP | 2004-156149 | A | 6/2004 |
| JP | 2008-002041 | A | 1/2008 |
| JP | 2008-088584 | A | 4/2008 |
| JP | 2010-047846 | A | 3/2010 |
| JP | 2012-251256 | A | 12/2012 |
| WO | 2010/038679 | A1 | 4/2010 |
| WO | 2010/119758 | A1 | 10/2010 |
| WO | 2015/056629 | A1 | 4/2015 |

OTHER PUBLICATIONS

First Office Action dated Apr. 1, 2020, issued in Chinese Application No. 201780046989.1, 10 pages.

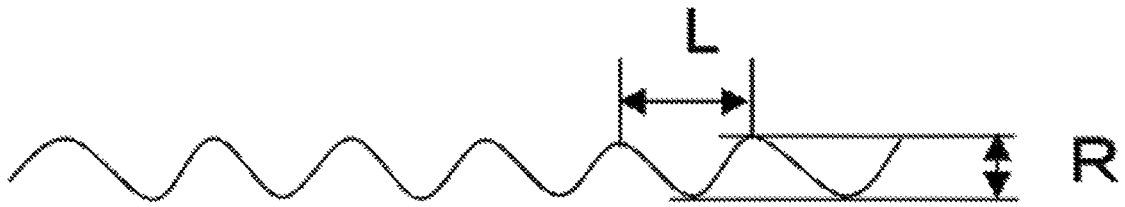
L
R

FIBERS FOR ARTIFICIAL HAIR

TECHNICAL FIELD

The present invention relates to a fiber used for artificial hair, such as wigs, hairpieces, and hair extensions, allowed to be put on and off of the head (hereinafter, simply referred to as "fiber for artificial hair").

BACKGROUND ART

As described in Patent Literature 1, materials making up a fiber for artificial hair include vinyl chloride resins. This is because vinyl chloride resins in the fiber for artificial hair are excellent in processability, cost reduction, and the like. As described in Patent Literature 2, such a fiber for artificial hair may be imparted with a wave shape by crimping for the purpose of controlling gloss and the like.

In the fiber for artificial hair using a vinyl chloride resin as a material, such a vinyl chloride resin is poor in heat resistance to heat from a hair iron and the like. For curling with a hair iron or the like generally set at a temperature of 100° C. or more, such fiber may thus be fused and frizzled and sometimes results in damage and breaking of the fiber. Accordingly, polyester-based fiber for artificial hair is under development, which is highly heat resistant (Patent Literature 3).

CITATION LIST

Patent Literature

Patent Literature 1: JP2004-156149
Patent Literature 2: JP2010-047846
Patent Literature 3: JP2008-088584

SUMMARY OF INVENTION

Technical Problem

The polyester-based fiber for artificial hair is excellent in that hair styles can be freely changed at home using a hair iron. On the other hand, with respect to the fiber artificial hair subjected to crimping, there is a problem that the wave shape of the fiber may be lost by the heat of the hair iron. Therefore, with the polyester-based fiber for artificial hair, it is not possible to freely change hair styles at home while maintaining the wave shape of the fiber.

The present invention has been made in view of such circumstances, and an object of the present invention is to provide a fiber for artificial hair which can freely change the hairstyle at home while maintaining the wave shape of the fiber.

Solution to Problem

According to the present invention, a fiber for artificial hair having a bending rigidity maintaining ratio defined by formula (1) is 40 to 80% and a heat shrinkage ratio defined by formula (2) is 0.0 to 5.0% is provided.

$$\text{Bending rigidity maintaining ratio (\%)}=100\times\{(\text{bending rigidity in a state after conditioning for 24 hours at 30° C.}\times\text{90\% RH})/(\text{bending rigidity in a state after conditioning for 24 hours at 23° C.}\times\text{50\% RH})\} \quad (1)$$

$$\text{Heat shrinkage ratio (\%)}=100\times\{(\text{length before heat treatment})-(\text{length after heat treatment for 5 min at 155° C.})\}/(\text{length before heat treatment}) \quad (2)$$

Since in the fiber for artificial hair of the present invention, the bending rigidity in the moisture-absorbed state is less than the bending rigidity in the dry state, it is possible to easily change the hairstyle by wetting the fiber with water and maintain the changed hairstyle by drying the fiber after the change. By this method, it is not necessary to heat the fiber for artificial hair, so that the loss of the wave shape of the fiber is suppressed. Therefore, according to the present invention, it is possible to freely change the hairstyle at home while maintaining the wave shape of the fiber.

In addition, the fiber for artificial hair of the present invention has a small heat shrinkage ratio by heat treatment at 155° C.×5 minutes, so that it is possible to crimp at a relatively high temperature and enhance retention of the crimped state.

BRIEF DESCRIPTION OF THE DRAWINGS

FIG. 1 is a schematic view showing a wave shape of a fiber for artificial hair according to one embodiment of the present invention.

DESCRIPTION OF EMBODIMENTS

Hereinafter, embodiments of the present invention will be described in detail.

<Bending Rigidity Maintaining Ratio>

A fiber for artificial hair of the present embodiment has a bending rigidity maintaining ratio defined by formula (1) is 40 to 80%.

$$\text{Bending rigidity maintaining ratio (\%)}=100\times\{(\text{bending rigidity in a state after conditioning for 24 hours at 30° C.}\times\text{90\% RH})/(\text{bending rigidity in a state after conditioning for 24 hours at 23° C.}\times\text{50\% RH})\} \quad (1)$$

"A state after conditioning for 24 hours at 30° C.×90% RH" means a state in which a fiber for artificial hair has absorbed moisture. "A state after conditioning for 24 hours at 23° C.×50% RH" means a state in which a fiber for artificial hair is dry. Therefore, the bending rigidity maintaining ratio indicates a change ratio of bending rigidity when a fiber for artificial hair absorbs moisture. The larger the bending rigidity maintaining ratio is, the smaller the decrease in bending rigidity due to moisture absorption is.

In the present embodiment, the bending rigidity maintaining ratio is 40 to 80%. This is because, in such a range, it is easy to change the hairstyles in a state in which the artificial hair fiber absorbs moisture, and thereafter the fiber for artificial hair is dried to easily maintain the changed hairstyle. The bending rigidity maintaining ratio is preferably 40 to 70%, more preferably 40 to 57%, even more preferably 45 to 57%.

Bending rigidity is measured by KES method. The KES method referred to in this specification is an abbreviation for Kawabata Evaluation System, which is a method of measuring the repulsive force at each curvature when a fiber structure is bent by using a bending property measuring instrument of KES (KES-FB2-SH manufactured by Kato Tech Co., Ltd.) as described by Yoshio Kawabata in Journal of Textile Machinery Society (Textile Engineering), vol. 26, No. 10, P 721-P 728 (1973). In the measurement in this embodiment, the average value of the repulsive force for one fiber at a curvature of 0.5 to 1.5 is measured.

<Heat Shrinkage Ratio>

In the fiber for artificial hair of the present embodiment, a heat shrinkage ratio defined by formula (2) is 0.0 to 5.0%.

$$\text{Heat shrinkage ratio (\%)}=100\times\{(\text{length before heat treatment})-(\text{length after heat treatment for 5 min at 155° C.})\}/(\text{length before heat treatment}) \quad (2)$$

Conventional polyamide artificial hair fiber has a property of shrinking when exposed to a high temperature of 155° C. Therefore, in order to prevent the fiber from shrinkage, a crimping process had to be performed at a relatively low temperature of about 120° C. In such the crimping process at low temperature, since the retention of the crimped state was low, the wave shape imparted by crimping easily lost. On the other hand, in the fiber for artificial hair of the present embodiment, since the heat shrinkage ratio by heat treatment of 155° C.×5 minutes is small, it is possible to perform the crimping process at a relatively high temperature. In that case, even if the fiber for artificial hair is moisture-absorbed to repeatedly change the hair style, the wave shape of the fiber is easily maintained. The heat shrinkage ratio is more preferably 3% or less.

<Wave Shape>

The fiber for artificial hair of the present embodiment preferably has a wave shape, and the wave shape is preferably within the range defined by formula (3). As shown in FIG. 1, L is length of one cycle of wave in the length direction of the fiber. When L is within the range of the formula (3), the appearance and feel of the fiber for artificial hair are particularly excellent. L is preferably 15 to 40 mm.

$$15\text{ mm}<L\leq 50\text{ mm} \quad (3)$$

The wave shape of the fiber of the present embodiment preferably is within a range defined by formula (4). As shown in FIG. 1, R is width of in the width direction of the fiber. When R is within the range of the formula (4), the appearance and tactile sensation of the fiber for artificial hair are particularly excellent. R is preferably 3.2 to 8 mm, more preferably 3.5 to 6 mm.

$$3\text{ mm}<R\leq 10\text{ mm} \quad (4)$$

<Single Fineness>

The single fineness of the fiber for artificial hair of the present embodiment is preferably 20 to 100 dtex, more preferably 35 to 80 dtex. If the single fineness is moderately large, it has moderate hardness, the retention of the wave shape and the quality tend to improve. On the other hand, if the single fineness is moderately small, the bending rigidity is not too large and the bending rigidity is appropriate, so that it tends to have a soft natural tactile sensation and to improve the knitting property.

<Resin Composition>

The resin composition constituting the fiber for artificial hair of the present embodiment comprises a base resin and optionally comprises an additive such as a flame retardant.

(Base Resin)

The base resin of the resin composition of the present embodiment preferably comprises polyamide. Polyamide has high hygroscopicity, so that inclusion of polyamide markedly reduces the bending rigidity of the fiber for artificial hair due to moisture absorption. The polyamide preferably comprises an aliphatic polyamide and may comprise a semi-aromatic polyamide having a skeleton obtained by condensation polymerization of an aliphatic polyamide, an aliphatic diamine and an aromatic dicarboxylic acid.

The aliphatic polyamide is a polyamide having no aromatic ring and examples of the aliphatic polyamide include: n-nylon synthesized by ring-opening polymerization of lactam; and n,m-nylon synthesized by co-polycondensation reaction of aliphatic diamine and aliphatic dicarboxylic acid. The number of carbon atoms in the lactam is preferably from 6 to 12, and more preferably 6. The number of carbon atoms of the aliphatic diamine and the aliphatic dicarboxylic acid is preferably 6 to 12, and more preferably 6. The aliphatic diamine and the aliphatic dicarboxylic acid preferably have functional groups (amino group or carboxyl group) at both ends of the carbon atom chain, but the functional group may be located at positions other than both ends. The carbon atom chain is preferably linear, but may have branch. Examples of the aliphatic polyamide include polyamide 6 and polyamide 66. From the viewpoint of heat resistance, polyamide 66 is preferable. Specifically, examples of polyamide 6 include CM 1007, CM 1017, CM 1017 XL 3, CM 1017 K, CM 1026 (these are manufactured by Toray Industries, Inc.), and the like. Examples of the polyamide 66 include CM 3007, CM 3001-N, CM 3006, CM 3301 L (these are manufactured by Toray Industries, Inc.), Zytel 101, Zytel 42 A (these are manufactured by Du Pont Co., Ltd.), Leona 1300 S, 1500, 1700 (these are manufactured by Asahi Kasei Chemicals Corporation), and the like.

Examples of the semi-aromatic polyamide having a skeleton obtained by condensation polymerization of the aliphatic diamine and the aromatic dicarboxylic acid include: polyamide 6T; polyamide 9T; polyamide 10T; modified polyamide 6T; modified polyamide 9T; and modified polyamide 10T (modified ones are obtained by copolymerizing with monomers for modifying). Among them, polyamide 10 T is preferable from the viewpoint of ease of melt molding. The carbon number of the aliphatic diamine is preferably from 6 to 10, more preferably 10. The aliphatic diamine preferably has an amino group at both ends of the carbon atom chain, but the amino group may be located at positions other than both ends. The carbon atom chain is preferably linear, but may have branch. Examples of the aromatic dicarboxylic acid include phthalic acid, isophthalic acid, terephthalic acid and the like. Among them, terephthalic acid is most preferable.

Specifically, examples of the polyamide 6T and its modified polymer include VESTAMID HP Plus M1000 manufactured by Evonik and ARLEN manufactured by Mitsui Chemicals, Inc. Examples of polyamide 9T and its modified polymer include GENESTAR manufactured by Kuraray Co., Ltd. Examples of polyamide 10 T and its modified polymer include VESTAMID HO Plus M 3000 manufactured by Evonik and Grivory manufactured by EMS-CHEMIE.

When the semi-aromatic polyamide is contained in the polyamide, the mixing ratio of the aliphatic polyamide and the semi-aromatic polyamide is preferably in a range of "50 parts by mass/50 parts by mass" to "99 parts by mass/1 part by mass", more preferably in a range of "70 parts by mass/30 parts by mass" to "90 parts by mass/10 parts by mass".

The weight average molecular weight (Mw) of the aliphatic polyamide is, for example, 65,000 to 150,000. When the Mw is 65,000 or more, the drip resistance becomes particularly good. On the other hand, when Mw exceeds 150,000, the melt viscosity of the material increases and the processability at the time of fiber formation deteriorates. Therefore, 150,000 or less is preferable. From the viewpoint of the balance of drip resistance and processability, more preferably, Mw is 70,000 to 120,000.

The base resin of the present embodiment may comprise a resin other than polyamide, but polyamide is preferably the main component. The proportion of the polyamide in the base resin is preferably from 50 to 100 mass %. This ratio is more preferably 60, 70, 80, 90, or 95 mass % or more.

(Flame Retardant)

The fiber for artificial hair of the present invention preferably comprises a flame retardant. The flame retardant is preferably a bromine-based flame retardant. The addition amount of the flame retardant is preferably 3 to 30 parts by mass, more preferably 5 to 25 parts by mass, and more preferably 5 to 15 parts by mass with respect to 100 parts by mass of the base resin. In such a case, the appearance, styling property and flame retardancy of the fiber for artificial hair are particularly improved.

Examples of the bromine-based flame retardant include a brominated phenol condensate, a brominated polystyrene resin, a brominated benzyl acrylate flame retardant, a brominated epoxy resin, a brominated phenoxy resin, a brominated polycarbonate resin and a bromine-containing triazine compound.

<Other Additives>

The resin composition of the present embodiment may contain additives such as a flame retardant aid, a fine particle, a heat resistant, a light stabilizer, a fluorescent agent, an antioxidant, an antistatic agent, a pigment, a dye, a plasticizer, a lubricant and the like, if necessary.

<Manufacturing Process>

Hereinafter, an example of a manufacturing process of a fiber for artificial hair will be described.

A method for producing the fiber for artificial hair according to an embodiment of the present invention comprises a melt spinning step, a drawing step, a heat treatment step, and a crimping step.

Each step will be described in detail below.

(Melt Spinning Step)

In the melt spinning step, an undrawn yarn is produced by melt spinning the resin composition. Specifically, first, the above-described resin composition is melt-kneaded. As a device for melt-kneading, various general kneading machines can be used. Examples of the device for melt kneading include a single screw extruder, a twin screw extruder, a roll, a Banbury mixer, a kneader and the like. Among them, a twin-screw extruder is preferable from the viewpoint of adjustment of kneading degree and ease of operation. The fiber for artificial hair can be produced by melt spinning by a usual melt spinning method under appropriate temperature conditions according to the kind of polyamide.

Temperature of a melt spinning apparatus such as an extruder, spinneret, (if necessary, a gear pump) and the like is set, for example, 270 to 310° C. to melt spin. The melt-spun resin composition is then cooled in a water tank containing cooling water, and the undrawn yarn is obtained by controlling the taking-up speed and the fineness. The temperature of the melt spinning apparatus can be appropriately adjusted depending on the composition of the resin composition. Cooling the melt-spun resin composition with cold air is also possible as well as the cooling by the water tank. The temperature of the cooling water tank, the temperature of the cold air, the cooling time, and the taking-up speed can be appropriately adjusted depending on the discharge amount and the number of holes of the spinneret.

The single fineness of the fiber for artificial hair in this embodiment is preferably 20 to 100 dtex (decitex), more preferably 35 to 80 dtex. In order to obtain this single fineness, it is preferable that the fineness of the fiber immediately after the melt spinning step (undrawn fiber) is 300 dtex or less. If the fineness of the undrawn yarn is small, the draw ratio may be small in order to obtain the fiber for artificial hair of fine fineness. In such condition, gloss does not easily occur in the fiber for artificial hair after the drawing, so that it tends to be easier to maintain a glossy state of semi-gloss to 7/10 gloss.

The cross-sectional area of the nozzle used for melt spinning is not particularly limited, but may be 0.1 to 2 mm. From the viewpoint of the quality aspect such as curl characteristics for artificial hair, it is preferable to melt and flow out from a nozzle in which each nozzle hole has a cross-sectional area of 0.5 $mm^2$ or less. If the cross-sectional area of each nozzle hole is less than 0.5 $mm^2$, the tension for forming the undrawn yarn or a heat drawn yarn of fine fineness is suppressed low, the residual strain is reduced, and the quality such as curl characteristics hardly deteriorates.

In melt spinning, the nozzle pressure is preferably 50 MPa or less. If the nozzle pressure is moderately small, since the load applied to the thrust portion of the extruder become low, troubles tend to hardly occur in the extruder, and resin leakage tends to hardly occur from the connecting portion of the turn head, die or the like.

As a spinneret used for melt spinning, a nozzle having one or more shapes selected from the group consisting of a circle shape, a cocoon shape, a Y shape, a H shape, and a X shape may be used. Since these spinnerets do not have complicated shapes, it is easy to fabricate molded fibers. In addition, the fibers produced using these spinnerets are easy to retain shape and are relatively easy to process.

(Stretching Step)

In the drawing step, the obtained undrawn yarn is drawn by 150 to 500% to produce a drawn yarn. By such drawing, it is possible to obtain a drawn yarn having a fineness of 100 dtex or less, and to improve the tensile strength of the fiber. The drawing may be performed by a two-step method in which an undrawn yarn is once wound on a bobbin and then drawn in another step different from the melt spinning step, or a direct spinning drawing method in which continuous drawing is carried out from the melt spinning step without winding on a bobbin. In addition, the drawing is carried out by a one-stage stretching method in which the film is drawn to a desired draw ratio at one time, or by a multistage drawing method in which drawing is performed to a desired draw ratio by two or more times of drawings. A heating roller, a heat plate, a steam jet device, a warm water tank, and the like can be used as a heating means in the case of conducting the hot drawing treatment, and these can also be appropriately used in combination. The draw ratio is preferably 200 to 400%. When the draw ratio is moderately larger, it tends to cause moderate strength development of the fiber. When the draw ratio is moderately smaller, it tends to make yarn breakage hardly occur in drawing.

The temperature during the drawing is preferably 90 to 120° C. If the drawing temperature is too low, the strength of the fiber tends to be lowered and thread breakage tends to occur, and if the drawing temperature is too high, the tactile sensation of the resulting fiber tends to be a plastic sliding tactile sensation.

(Heat Treatment Step)

In the heat treatment step, heat treatment is performed on the drawn yarn at a heat treatment temperature of 155° C. or higher. By this heat treatment, the thermal shrinkage factor of the drawn yarn can be lowered. The heat treatment can be carried out continuously after the stretching treatment, or it can be carried out after once winding up and taking some interval. The heat treatment temperature is set to 155° C. or higher in order to suppress the thermal shrinkage of the drawn yarn when crimping is performed at a high temperature of 140° C. or more. The heat treatment temperature is preferably 160° C. or higher, more preferably 170° C. or higher, further preferably 180° C. or higher. The upper limit of the heat treatment temperature is not particularly limited, but is, for example, 220° C.

(Crimping Step)

In the crimping step, crimping is performed on the drawn yarn after the heat treatment. The crimping is performed at a temperature of 140° C. or higher and lower than the heat treatment temperature. It is possible to impart a wave shape to the fiber for artificial hair which is hard to disappear by crimping at 140° C. or higher. By crimping at a temperature lower than the heat treatment temperature, it is possible to suppress the thermal shrinkage of the drawn yarn during the crimping. The temperature of the crimping is preferably 150° C. or higher, more preferably 155° C. or higher. The temperature of the crimping is lower than the heat treatment temperature by 5° C. or more, preferably by 10° C. or more, more preferably by 15° C. or more. In the crimping, it is preferable that the wave shape of the drawn yarn satisfies at least one of the formulas (3) and (4).

In the crimping step, a gear crimping process method and a woolly process method may be used, preferably a gear crimp process method is used.

The gear crimping process method is a method of crimping by passing a fiber bundle between two meshing high temperature gears.

The gear crimping process method can control the wave shape of the fiber for artificial hair by controlling the depth of the groove of the gear waveform, the surface temperature of the gear, and the processing speed.

When the depth of the groove of the gear waveform is appropriate, the crimp is moderately strong, and it tends to give a proper swing width to the fiber for artificial hair. In addition, when the depth of the grooves of the gear waveform is appropriately small, the degree of the crimp is not too strong, and the swing width of the fiber for artificial hair also tends to be small. Therefore, the depth is preferably 1 mm to 20 mm, more preferably 2 mm to 10 mm.

When the surface temperature of the gear is moderately high, it tends to easily impart a swing width to the fiber for artificial hair. In the case of gear crimping process, the surface temperature of the gear is the above-mentioned crimping temperature.

When the processing speed with the gear is moderately high, the swing width of the fiber for artificial hair tends to be small. In addition, since the crimp tends to be moderately strong if the processing speed with the gear is moderately slow, it tends to easily impart a swing width to the fiber for artificial hair. Therefore, the processing speed with the gear is preferably 0.5 to 10 m/min, more preferably 1.0 to 8.0 m/min.

When preheating the fiber for artificial hair before passing through the gear, since the fiber is not fast overheated, more stable productivity and uniform waveform can be obtained.

The total fineness of the fiber bundle in gear crimping process is moderately large, the yarn breakage by crimping hardly occur, and the productivity tends to be improved. In addition, since it tends to easily obtain a uniform wave shape if the total fineness of the fiber bundle in gear crimping process moderately small. Therefore, the total fineness of the fiber bundle is preferably 100,000 to 2,000,000 dtex, more preferably 500,000 to 1,500,000 dtex.

By the gear crimping process, since the time for heating the fiber is relatively short, evaporation of moisture from the inside of the fiber during crimping process is little, and yarn breakage or damage is small. For a fiber artificial hair, moisture is an important factor to give a moist feel close to natural hair. Therefore, it can be said that the fiber for artificial hair produced by the gear crimping process is good in quality and productivity. In addition, since the gear crimping process does not require a long working time, complicated apparatuses, and complicated steps, it is an excellent processing method in workability, productivity, or accuracy. Furthermore, since it has high controllability, it is a processing method suitable for imparting a desired waveform on a fiber.

EXAMPLES

<Production of Fibers for Artificial Hair of Examples and Comparative Examples>

Each component constituting the resin compositions shown in Table 1 was blended and the blended materials were kneaded using a 00 mm twin screw extruder to obtain resin composition pellets for spinning.

Then, the pellets were dehumidified and dried so that a water absorption rate of the pellets was 1000 ppm or less. Thereafter, it was spun using a φ40 mm single-axis melt spinning machine. The spinning is carried out by cooling the molten resin discharged from a die having a hole diameter of 0.5 mm through a water bath at about 30° C. while adjusting the discharge amount and the winding speed. Thereby, a undrawn yarn having setting fineness was produced. The set temperature of the φ40 mm melt spinning machine was appropriately adjusted according to the composition of the resin composition.

The obtained undrawn yarn was drawn at 100° C. by 300% to obtain a drawn yarn, and thereafter heat treatment of the drawn yarn was performed at the heat treatment temperature shown in Table 1.

Next, the drawn yarn after the heat treatment was made into a fiber bundle having a total fineness of 1,000,000 dtex, and subjected to gear crimping process to obtain a fiber for artificial hair of Examples and Comparative Examples. In the gear crimping process, a gear made of brass (diameter 13 cm, interval of waves of 7 mm, depth of wave of 7 mm) was used, the surface temperature and the rotation speed were set as shown in Table 1.

TABLE 1

| | | Example | | | | | | | | | |
|---|---|---|---|---|---|---|---|---|---|---|---|
| | | 1 | 2 | 3 | 4 | 5 | 6 | 7 | 8 | 9 | 10 |
| Resin Composition | PA6 | 100 | — | — | — | — | — | — | — | — | — |
| | PA66 | — | 100 | 90 | 80 | 70 | 100 | 100 | 100 | 100 | 100 |
| | PA10T | — | — | 10 | 20 | 30 | — | — | — | — | — |
| | PET | — | — | — | — | — | — | — | — | — | — |
| | PVC | — | — | — | — | — | — | — | — | — | — |
| | Bromine-based Flame Retardant | — | — | — | — | — | 10 | 20 | 30 | — | — |

TABLE 1-continued

| | | | | | | | | | | | |
|---|---|---|---|---|---|---|---|---|---|---|---|
| Heat Treatment | Heat Treatment Temperature (° C.) | 180 | 180 | 180 | 180 | 180 | 180 | 180 | 180 | 180 | 180 |
| Crimping | Surface Temperature of Gear (° C.) | 160 | 160 | 160 | 160 | 160 | 160 | 160 | 160 | 180 | 160 |
| Process | Rotational Speed of Gear (m/min) | 2.0 | 2.0 | 2.0 | 2.0 | 2.0 | 2.0 | 2.0 | 2.0 | 2.0 | 0.8 |
| Waveform | Swing Width R | 4.1 | 3.8 | 4.5 | 4.3 | 4.1 | 3.8 | 3.6 | 3.9 | 5.5 | 5.8 |
| Shape | Length L of One Cycle | 19.8 | 18.5 | 19.5 | 20.3 | 19.5 | 18.8 | 19.5 | 19.2 | 17.2 | 12.4 |
| Properity | Bending Rigidity Maintaining Ratio (%) | 48 | 53 | 57 | 59 | 73 | 56 | 63 | 71 | 53 | 53 |
| | Heat Shrinkage Ratio (%) | 2.8 | 1.2 | 1.3 | 1.1 | 1.2 | 1.0 | 1.2 | 1.2 | 1.2 | 1.2 |
| Evaluation | Retention of Crimped State | ○ | ○ | ○ | ○ | ○ | ○ | ○ | ○ | ○ | ○ |
| | Styling Property | ⊙ | ⊙ | ⊙ | ○ | Δ | ⊙ | ○ | Δ | ⊙ | ⊙ |
| | Appearance | ○ | ○ | ○ | ○ | ○ | ⊙ | ⊙ | ○ | ○ | ○ |
| | Tactile Sensation | ○ | ○ | ○ | ○ | ○ | ○ | ○ | ○ | Δ | Δ |
| | Flame Retardancy | Δ | Δ | Δ | Δ | Δ | ○ | ⊙ | ⊙ | Δ | Δ |

| | | Example | | Comparative Example | | | | | | | |
|---|---|---|---|---|---|---|---|---|---|---|---|
| | | 11 | 12 | 1 | 2 | 3 | 4 | 5 | 6 | 7 | 8 |
| Resin | PA6 | — | — | — | — | 100 | — | 100 | — | — | — |
| Composition | PA66 | 100 | 100 | 60 | 100 | — | 100 | — | 100 | — | — |
| | PA10T | — | — | 40 | — | — | — | — | — | — | — |
| | PET | — | — | — | — | — | — | — | — | 100 | — |
| | PVC | — | — | — | — | — | — | — | — | — | 100 |
| | Bromine-based Flame Retardant | — | — | — | 40 | — | — | — | — | — | — |
| Heat Treatment | Heat Treatment Temperature (° C.) | 180 | 180 | 180 | 180 | 150 | 150 | 150 | 150 | 180 | 120 |
| Crimping | Surface Temperature of Gear (° C.) | 160 | 160 | 160 | 160 | 160 | 160 | 120 | 120 | 100 | 80 |
| Process | Rotational Speed of Gear (m/min) | 4.0 | 9.0 | 2.0 | 2.0 | 2.0 | 2.0 | 2.0 | 2.0 | 2.0 | 2.0 |
| Waveform | Swing Width R | 2.4 | 1.3 | 3.9 | 4.2 | 4.9 | 4.6 | 3.1 | 3.3 | 3.8 | 4.2 |
| Shape | Length L of One Cycle | 32.8 | 52.4 | 18.1 | 20.1 | 17.2 | 17.5 | 22.3 | 21.5 | 19.0 | 18.6 |
| Properity | Bending Rigidity Maintaining Ratio (%) | 53 | 53 | 88 | 82 | 48 | 53 | 48 | 53 | 97 | 98 |
| | Heat Shrinkage Ratio (%) | 1.2 | 1.2 | 1.1 | 1.1 | 7.8 | 6.6 | 7.8 | 6.6 | 2.2 | 62.3 |
| Evaluation | Retention of Crimped State | ○ | ○ | ○ | ○ | ○ | ○ | X | X | ○ | ○ |
| | Styling Property | ⊙ | ⊙ | X | X | ⊙ | ⊙ | ⊙ | ⊙ | X | X |
| | Appearance | ○ | Δ | ○ | ○ | X | X | ○ | ○ | ○ | ○ |
| | Tactile Sensation | ○ | ○ | ○ | ○ | X | X | ○ | ○ | ○ | ○ |
| | Flame Retardancy | Δ | Δ | Δ | ⊙ | Δ | Δ | Δ | Δ | Δ | ⊙ |

The materials shown in Table 1 were as follows.

PA 6 (weight average molecular weight 90000): made in-house

PA 66 (weight average molecular weight 90000): Zytel 42A, manufactured by DuPont.

Polyamide 10T: VESTAMID HO Plus M 3000, manufactured by Daicel-Evonik Ltd.

PET: J125S, manufactured by Mitsui Chemicals, Inc.

PVC: TH-500, manufactured by Taiyo Vinyl Corporation.

Bromine-based Flame Retardant: brominated epoxy resin SRT-20000, manufactured by Sakamoto Yakuhin Kogyo Co., Ltd.

<Various Measurement and Evaluation>

Various properties and physical properties were measured and evaluated by the following methods.

(Weight Average Molecular Weight: Mw)

The weight average molecular weight Mw was determined by measurement under the following equipment and conditions.

Equipment used: [Pump] shodex DS-4

[Column] shodex GPC HFIP-806M×2+HFIP-803

[Detector] shodex RI-71

Eluent: hexafluoroisopropanol (+additive $CF_3COONa$ (5 mmol/L))

Pretreatment: Filtration through a membrane filter−(0.2 μm)

Concentration: 0.2 w/v %

Injection volume: 100 μL

Column temperature: 40° C.

Flow rate: 1.0 ml/min.

Standard substance: standard polymethyl methacrylate (PMMA) (The calibration curve was prepared by standard PMMA, and the weight average molecular weight was expressed as PMMA equivalent value.)

(Bending Rigidity Maintaining Ratio)

The bending rigidity maintaining ratio was calculated according to the above-mentioned formula (1). For measurement of "bending rigidity", KES-FB2-SH manufactured by Kato Tech Co., Ltd. was used. One fiber having a length of 9 cm was passed through a jig having a diameter of 0.2 mm, and a pure bending test was carried out under conditions of: a deformation rate of 0.2 ($cm^{-1}$) in a range of a curvature of −2.5 to +2.5 ($cm^{-1}$); "SENS setting" on the soft side is 2×5, "SENS setting" on the device side 0.08. The average value of the repulsive force for one fiber at a curvature of 0.5 to 1.5 was measured and evaluated based on the value obtained by dividing the displayed value by 50. The bending rigidity in a state after conditioning for 24 hours at 30° C.×90% RH was measured at 23° C.×50% RH immediately after conditioning for 24 hours at 30° C.×90% RH. The bending rigidity in a state after conditioning for 24 hours at 23° C.×50% RH was measured at 23° C.×50% RH immediately after conditioning for 24 hours at 23° C.×50% RH.

(Heat Shrinkage Ratio)

The heat shrinkage ratio was calculated according to the above-mentioned formula (2), by heating a fiber having a length of 100 mm before crimping in a gear oven at 155° C. for 5 minutes and measuring lengths of the fiber before and after the heating.

(Retention of Crimped State)

Retention of the crimped state was evaluated by storing the crimped yarn in a constant temperature and humidity room (23° C., 50% RH) for 3 days, calculating the rate of change of the swing width R before and after storage, and evaluating according to the following criteria.

O: less than 10% x: 10% or more (Styling Property)

Styling property was evaluated by the following method. 1 g of a fiber bundle of 200 mm of a length is wrapped around an aluminum cylinder of 18 mm in diameter and both ends are fixed. The aluminum cylinder (with the fiber wound thereon) was dipped in water at room temperature for 10 seconds, and subsequently left in a thermostatic chamber at 23° C. and 50% of a relative humidity for 6 hours. After that, the fiber bundle was removed from the aluminum cylinder, and one end was fixed and suspended. It was evaluated by dividing the length from the root to the tip by the total length before curling (200 mm). The smaller the value, the more curl is imparted.

⊙: less than 0.6

O: 0.6 or more and less than 0.75

Δ: 0.75 or more and less than 0.85 x: 0.85 or more (Appearance)

The appearance was evaluated by observing a bundle of the fiber for artificial hair having 200 mm of a length and 3,000 pieces under sunlight, according to the following evaluation criteria.

⊙: It has the same appearance as human hair.

O: Although a difference is recognized as compared with human hair, it generally has an appearance close to human hair.

Δ: Although a difference from human hair is recognized by detailed observation, it generally has an appearance that can withstand use as fiber for artificial hair.

x: At first glance, there is a difference in appearance from human hair.

(Tactile Sensation)

Tactile sensation was evaluated based on hand touch by 10 technicians in the field of processing a fiber for artificial hair (work experience of 5 years or more) using a fiber bundle sample having 250 mm of a length and 20 g of a weight, according to the following evaluation criteria.

O: Moe than nine technicians evaluated that feeling was good.

Δ: Seven or eight technicians evaluated that feeling was good.

x: Six or fewer technicians evaluated that the tactile impression was good.

(Flame Retardancy)

A fiber bundle having 30 cm of a length and 2 g of a weight was prepared. The flame retardancy was evaluated by measuring fire spreading time after an end of the fiber bundle being made to contact with a flame of 20 mm in length for 5 seconds and keeping away from the flame, according to the following evaluation criteria. The result is based on the average value of the results measured three times.

⊙: Fire spreading time is less than 1 second

O: Fire spreading time is 1 second or more and less than 5 seconds

Δ: Fire spreading time is 5 seconds or more and less than 10 seconds x: Fire spreading time is 10 seconds or more and less than 20 seconds xx: Fire spreading time is 20 seconds or more

DISCUSSION

In all Examples, good results were obtained for all the evaluation items.

In Comparative Examples 1 to 2 and 7 to 8, since the bending rigidity maintaining ratio was too large, the styling property was bad.

In Comparative Examples 3 to 4, since the heat treatment was performed at a relatively low temperature (150° C.), the thermal shrinkage ratio was increased. In addition, since the crimping was performed at a temperature higher than the heat treatment temperature (160° C.), the fiber for artificial hair was excessively crimped during the crimping, and the appearance and the tactile sensation deteriorated.

In Comparative Examples 5 to 6, since the heat treatment was performed at a relatively low temperature (150° C.), the thermal shrinkage ratio was increased. In addition, since the crimping was performed at a low temperature of 120° C., the wave shape was weakly imparted to the fiber for artificial hair, and retention of the crimped state was poor.

The invention claimed is:

1. A fiber for artificial hair having a bending rigidity maintaining ratio defined by formula (1) is 40 to 80% and a heat shrinkage ratio defined by formula (2) is 0.0 to 5.0%, $$\text{bending rigidity maintaining ratio (\%)}=100\times\{(\text{bending rigidity in a state after conditioning for 24 hours at 30° C.}\times 90\%\text{ RH})/(\text{bending rigidity in a state after conditioning for 24 hours at 23° C.}\times 50\%\text{ RH})\} \quad (1)$$

$$\text{heat shrinkage ratio (\%)}=100\times\{(\text{length before heat treatment})-(\text{length after heat treatment for 5 min at 155° C.})\}/(\text{length before heat treatment}) \quad (2)$$

wherein a waveform shape of the fiber is within a range defined by formula (3), $$15\text{ mm}<L\leq 50\text{ mm} \quad (3), \text{ and}$$

the wave shape of the fiber is within a range defined by formula (4), $$3\text{ mm}<R\leq 10\text{ mm} \quad (4),$$

wherein L is length of one cycle of wave in the length direction of the fiber and R is width of in the width direction of the fiber.

2. The fiber for artificial hair of claim 1, wherein the fiber for artificial hair comprises polyamide.

3. The fiber for artificial hair of claim 2, wherein the fiber for artificial hair comprises a bromine-based flame retardant.

4. A method for producing the fiber for artificial hair of claim 1, comprising:

a melt spinning step of producing an undrawn yarn by melt spinning a resin composition;

a drawing step of drawing the undrawn yarn by 150 to 500% to produce a drawn yarn;

a heat treatment step of heat treating the drawn yarn at a heat treatment temperature of 155° C. or higher;

a crimping step of crimping the drawn yarn after the heat treatment, wherein the crimping is performed at a temperature of 140° C. or higher and lower than the heat treatment temperature.

5. The method of claim 4, wherein the resin composition comprises polyamide.

6. The method of claim 5, wherein the resin composition comprises a bromine-based flame retardant.

7. The method of claim 4, wherein the crimping is performed so that the wave shape of the drawn yarn is within a range defined by formula (3), $$15\text{ mm}<L\leq 50\text{ mm} \quad (3),$$

wherein L is length of one cycle of wave in the length direction of the fiber.

8. The method of claim 4, wherein the crimping is performed so that wherein the wave shape of the fiber is within a range defined by formula (4), $$3\ \text{mm} < R \leq 10\ \text{mm} \quad (4),$$

wherein R is width of in the width direction of the fiber.

9. The method of claim 4, wherein the crimping is a gear crimping.

10. A method for producing an artificial hair comprising: a step of producing the artificial hair using the fiber for artificial hair produced by the method according to claim 4.

11. An artificial hair comprising the fiber for artificial hair of claim 1.

* * * * *